US009194539B1

(12) United States Patent
James et al.

(10) Patent No.: US 9,194,539 B1
(45) Date of Patent: Nov. 24, 2015

(54) STORAGE ASSEMBLY AND A METHOD FOR MAKING THE SAME

(75) Inventors: Brian D. James, Alexandria, VA (US); Jonathan Wing-Fai Ho, Falls Church, MI (US); John Patrick Reardon, Littleton, CO (US)

(73) Assignee: Ford Motor Company, Dearborn, MI (US)

( * ) Notice: Subject to any disclaimer, the term of this patent is extended or adjusted under 35 U.S.C. 154(b) by 1211 days.

(21) Appl. No.: 10/064,930

(22) Filed: Aug. 29, 2002

(51) Int. Cl.
*F17C 11/00* (2006.01)

(52) U.S. Cl.
CPC ..... *F17C 11/00* (2013.01)

(58) Field of Classification Search
CPC ..... F17C 11/00
USPC ..... 96/108, 131, 134, 154; 206/0.7; 423/248, 648.1; 420/900; 502/526
See application file for complete search history.

(56) References Cited

U.S. PATENT DOCUMENTS 4,589,919 A 5/1986 Goodell et al.
4,687,650 A 8/1987 Goodell et al.
4,819,718 A * 4/1989 Ishikawa et al. ..... 165/104.12
4,917,862 A * 4/1990 Kraw et al. ..... 422/4
5,688,611 A 11/1997 Golben
5,862,855 A 1/1999 Balk
5,953,922 A 9/1999 Stetson et al.
6,015,041 A * 1/2000 Heung ..... 206/70
6,042,960 A 3/2000 Da Costa et al.
6,352,578 B1 * 3/2002 Sakata et al. ..... 96/134
6,616,738 B2 * 9/2003 Iwamoto et al. ..... 96/146
6,638,348 B2 * 10/2003 Kuriiwa et al. ..... 96/146
2001/0035094 A1 * 11/2001 Takagaki et al. ..... 96/154

FOREIGN PATENT DOCUMENTS

DE 3150133 A1 * 7/1983

* cited by examiner

*Primary Examiner* — Frank Lawrence
(74) *Attorney, Agent, or Firm* — David Kelley, Esq.; Tung & Associates

(57) ABSTRACT

A storage assembly 10 having at least one sub-assembly 12 which includes a plurality of material storage cells 49 which are operatively disposed along a certain axis 51 and which have generally planar material containment surfaces 16. The cells 49 are cooperatively formed by a member 14, a plurality of conductive fins 26 which reside upon member 14, and by a compliant member 42. A desired number of sub-assemblies 12 may be selectively and stackably coupled to form the storage assembly 10.

18 Claims, 3 Drawing Sheets

STORAGE ASSEMBLY AND A METHOD FOR MAKING THE SAME

BACKGROUND OF INVENTION (1) Field of the Invention

The present invention generally relates to a storage assembly and to a method for making the same and more particularly, to a metal hydride storage assembly which efficiently and selectively receives/stores and emits hydrogen gas and which may be relatively easily and cost effectively manufactured and scaled to readily accommodate a wide variety of diverse storage requirements.

(2) Background of the Invention

Metal hydride material is known to efficiently receive/store and selectively emit hydrogen gas. Accordingly, such material has been used in vehicular applications in which a fuel cell assembly is used to operate a vehicle. Although various types of fuel cells exist, a common type of fuel cell uses hydrogen gas in combination with another material (e.g., gasoline) to produce electricity. The hydrogen gas is typically provided by a reformation system and is communicated to the fuel cell assembly by a controller, according to a sensed demand. In order to improve response and efficiency, metal hydride material has been used as a buffer and, in this configuration, is operatively effective to allow a hydrogen powered type of fuel cell assembly ready or quick access to hydrogen when a large demand is placed upon the fuel cell assembly, thereby reducing the overall response time and allowing the fuel cell to operate at peak efficiency and to deliver the desired output power level.

The metal hydride buffer is further operatively effective to receive hydrogen gas produced by the reformation system and to allow the reformation system to continue to efficiently produce relatively large amounts of hydrogen even when a relatively small demand is placed upon the fuel cell assembly. Such a sinking type buffer has been found to increase the overall operating efficiency of the hydrogen producing reformation system since the buffer allows the reformation system to operate at a relatively large or production capacity (e.g., the reformation system operates most efficiently when it is producing large amounts of hydrogen), even when all of the produced hydrogen is not used by the fuel cell assembly. Hence, one of the principal benefits of such a buffer is to store the hydrogen which would be otherwise wasted if the required load or amount of required hydrogen drops at a faster rate than the rate at which the reformation system may reduce its output, and to provide hydrogen when the amount of required hydrogen increases at a faster rate than the rate at which hydrogen may be supplied by the reformation system.

Particularly, the metal hydride material, in the form of a powder, is usually contained within several tubes which are disposed within a manifold storage assembly which may be generally round. The storage assembly is selectively heated in order to cause the contained material to absorb hydrogen and is selectively cooled in order to cause the material to emit or de-absorb the previously received hydrogen and to allow the emitted hydrogen to be communicated to the fuel cell assembly.

While the foregoing storage assembly does provide some of the desired hydrogen buffering, it suffers from some undesirable drawbacks. That is, by way of example and without limitation, the foregoing metal hydride storage assembly does not readily transfer the applied energy (e.g., the heat or the cold energy) to the contained metal hydride material, thereby causing the storage assembly to operate inefficiently and to undesirably reduce the overall response time of the assembly (i.e., the time in which hydrogen is emitted or absorbed after such absorption or emission is requested by the generation of the energy in the form of heat or cold). Attempts to increase the heat transfer attribute of the storage assembly include machining or removing portions of the walls of the tubes and/or placing one or more conductive members within each of the tubes. These attempts undesirably increase the cost and complexity of the storage assembly and cause or increase the likelihood of damage to the assembly as well as increasing the amount of required maintenance.

Further, the foregoing storage assembly is relatively difficult to manufacture, requiring a relatively large amount of uniquely shaped components which must be intricately coupled in a certain manner, and the foregoing storage assembly suffers from compaction type failures (i.e., as the contained material is repeatedly heated and cooled or cycled, the metal hydride particles become smaller and migrate to various locations within the assembly where, upon again becoming heated, they swell and structurally damage the storage assembly). Attempts to address these compaction type failures undesirable increase cost and complexity of the assembly by requiring the use of a segmented member in each of the tubes and/or undesirably thickening the walls of the tube.

Moreover, the foregoing metal hydride storage assembly is not readily and cost effectively scaleable (i.e., not capable of being readily adapted to contain varying amounts of material) since the manifold storage assembly has a fixed amount of tubular reception apertures which contribute to the overall space requirements of the assembly even when they fail to operatively contain material, the prior assembly undesirably requires a relatively large amount of storage or mounting space within the vehicle, and the prior assembly is not easily adapted to be manufactured in a variety of sizes.

There is therefore a need for a new and improved metal hydride storage assembly and a method for making such a new and improved assembly which overcomes some or all of the previously delineated disadvantages of prior assemblies.

SUMMARY OF INVENTION

It is a first non-limiting advantage of the present invention to provide a metal hydride storage assembly which overcomes some or all of the previously delineated disadvantages of prior metal hydride storage assemblies.

It is a second non-limiting advantage of the present invention to provide a relatively uncomplicated and cost effective method for making a metal hydride storage assembly.

It is a third non-limiting advantage of the present invention to provide a metal hydride storage assembly which overcomes some or all of the previously delineated disadvantages of prior metal hydride storage assemblies, and which includes material reception cells which may readily and selectively receive energy.

It is a fourth non-limiting advantage of the present invention to provide a metal hydride storage assembly which overcomes some or all of the previously delineated disadvantages of prior metal hydride storage assemblies, which may be readily scaleable and has a significantly reduced likelihood of compaction failure relative to the foregoing described prior metal hydride storage assemblies.

It is a fifth non-limiting advantage of the present invention to provide a metal hydride storage assembly which overcomes some or all of the previously delineated disadvantages of prior metal hydride storage assemblies and which is relatively corn pact.

According to a first aspect of the present invention, a material storage assembly is provided. Particularly, the assembly comprises a plurality of material reception cells; and a compliant member which overlays the plurality of material reception cells.

According to a second aspect of the present invention an assembly is provided. Particularly, the assembly comprises a first and a second substantially identical storage assembly, each of the first and second storage assemblies respectively having a plurality of metal hydride storage cells, a plurality of heat transfer members which are communicatively coupled to the plurality of metal hydride storage cells, and a filter member which overlays the metal hydride storage cells and wherein the respective plurality of heat transfer members of the first storage assembly are physically and communicatively coupled to the plurality of metal hydride storage cells of the second storage assembly, thereby allowing energy to be efficiently transferred to each of the plurality of metal hydride storage cells of each of the first and second storage assemblies and allowing hydrogen gas to emanate from the assembly.

According to a third aspect of the present invention, a method for forming a metal hydride storage assembly is provided. The method comprising the steps of: creating a first member having a first and a second surface; providing a first and a second plurality of fins; attaching the first plurality of fins to the first surface, effective to create a plurality of material reception cells; attaching the second plurality of fins to the second surface; providing a third member; attaching the third member to the second plurality of fins; providing a filter sheet; attaching the filter sheet to the first plurality of fins, thereby forming a first metal hydride storage sub-assembly; creating a second metal hydride storage sub-assembly which is substantially identical to the first metal hydride storage sub-assembly; and coupling the second metal hydride storage sub-assembly to the second plurality of fins of the first metal hydride storage sub-assembly, thereby forming the metal hydride storage assembly.

These and other features, aspects, and advantages of the present invention will become apparent from a reading of the following detailed description of the preferred embodiment of the invention in combination with the following drawings.

DETAILED DESCRIPTION

Figure 1:
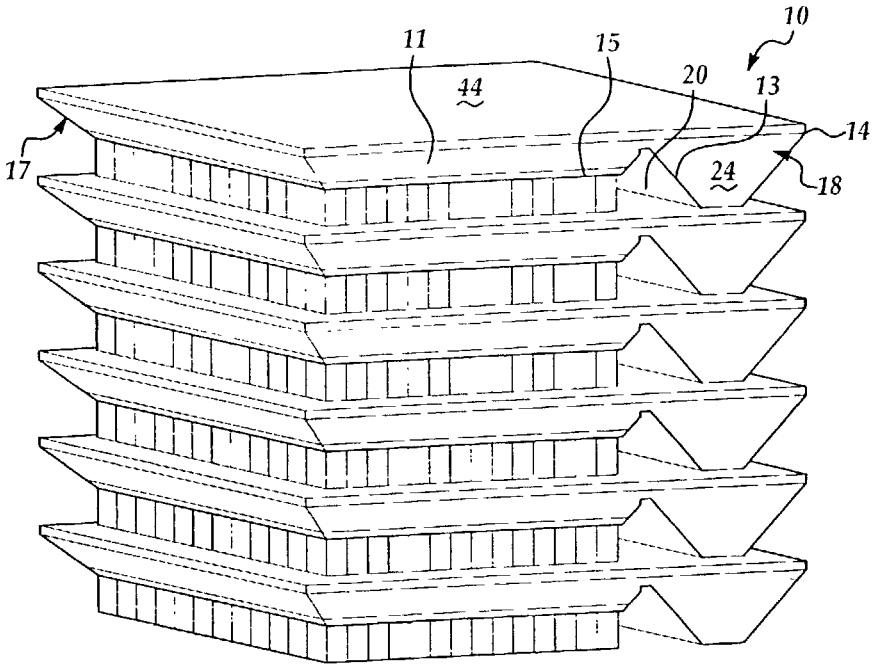
FIG. 1 is a perspective view of a metal hydride storage assembly which is made in accordance with the teachings of the preferred embodiment of the invention.
Figure 2:
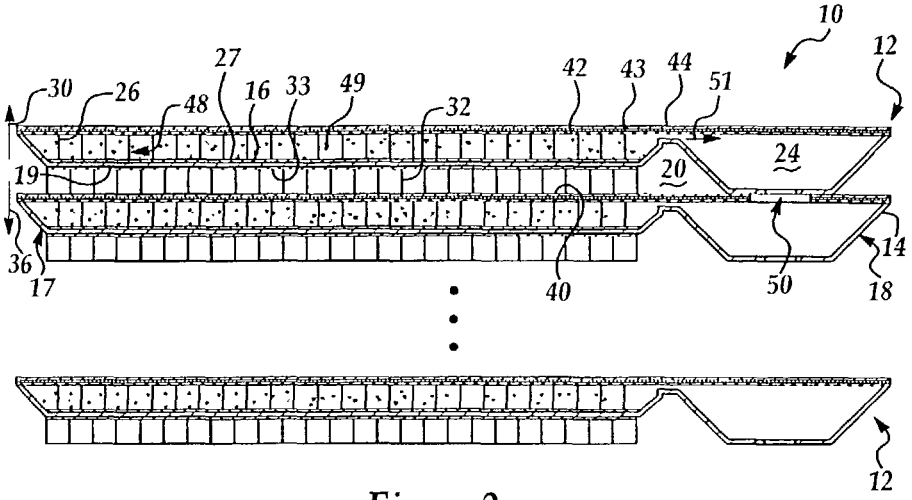
FIG. 2 is a side sectional view of the metal hydride storage assembly which is shown in FIG. 1.

Referring now to FIGS. 1 and 2, there is shown a metal hydride storage assembly 10 which is made in accordance with the teachings of the preferred embodiment of the invention and which may operatively function as a hydrogen fuel cell buffer.

Particularly, metal hydride storage assembly 10 includes a selectable number of substantially identical metal hydride storage sub-assemblies 12 which, as is more fully explained below, each contain a selected number of material containment cells and are selectively and operatively coupled or stacked in order to cooperatively form the storage assembly 10. In this manner, metal hydride storage assembly 10 may be selectively and desirably scaled or sized in a desired manner in order to reduce the overall storage requirements while concomitantly allowing the fuel cell and reformation assemblies and systems to efficiently operate. Moreover, the use of substantially identical and relatively uncomplicated sub-assemblies 12 allows the assembly 10 to be efficiently manufactured in a relatively cost-effective manner. It should be further realized that, in one non-limiting embodiment of the invention, only a single sub-assembly 12 may function as a fuel cell buffer and that in a further non-limiting embodiment, the coupled sub-assemblies 12 may each have different numbers of material containment cells (e.g., each sub-assembly 12 may have a unique number of material containment cells).

As shown, each metal hydride storage sub-assembly 12 includes a first conductive member 14 having a bottom surface 15 having a first substantially flat portion 16, which, as is more fully described below, is used to form material containment cells, and a portion 13 which forms a pair of flared or angled corners 18. The term conductive, as used throughout this description, means that the member readily transfers the hot or cold type energy which it receives to other members or assemblies in physical contact with it.

As further shown, member 14 includes a first pair of substantially identical flared and/or angled corners 17. As shown, each portion 13 at each corner 18 forms a respective downwardly extending pocket 20 and upwardly extending pocket 24 which allow the member 14 to be easily grasped during the manufacturing of assembly 10. Further, the member 14 includes a side wall portion 11 which is integrally formed with and which extends around the perimeter of surface 15.

Further, storage assembly 12 includes a first plurality of substantially identical and conductive fins or members 26 which are disposed upon surface 16, which extend along surface 16, and which extend from surface 16 in a first direction 30, and a second plurality of substantially identical conductive fins 32 which are disposed upon the opposing surface 19 of the member 14 (i.e., the surface of the member 14 opposite of surface 16) and which extend from the second surface 19 along a second direction 36 which is opposite to the first direction 30. In one non-limiting embodiment, fins 26 and 32 are each substantially identical and comprise relatively thin and generally flat members having a substantially rectangular cross sectional area. Fins 26, 32 may be manufactured from aluminum, copper, or any other desired and thermally conductive material. In yet another non-limiting embodiment of the invention, fins 26 are disposed upon a first sheet 27 while fins 32 are disposed upon a second sheet 33 and, in this non-limiting embodiment, sheet 27 is coupled to surface 16 while sheet 33 is coupled to surface 19. Particularly, sheets 27 and 33 may be brazed to the respective surface 16 and 19 or attached to the respective surfaces by any other conventional methodologies.

Moreover, the storage sub-assembly 12 further includes a second generally flat and conductive member 40 which overlays and is coupled to each of the second plurality of conductive fins 32 and which cooperates with the member 14 to fix the conductive fins 32 in an operative position between the member 40 and the surface 19 of the member 14. Storage sub-assembly 12 further includes a compliant filter sheet 42 which may be coupled to, or which may only overlay, the first plurality of thermally conductive fins 26 and which substantially "covers" all of the fins 26. Filter sheet 42 substantially prevents or reduces the likelihood of contaminant materials entering the sub-assembly 12 while permitting hydrogen gas to pass through and enter the sub-assembly 12. Storage sub-assembly 12 also includes a substantially compliant and conductive wire mesh sheet 43 which is substantially similar in size and shape to the compliant filter sheet 42 and which is coupled to and resides on top of the compliant filter sheet 42.

In another alternate embodiment of the invention, sheet 43 only overlays filter sheet 42 and is not coupled to the filter sheet 42.

In the preferred embodiment of the invention, a plurality of sub-assemblies 12 are stackably coupled, such that a member 40 of a first sub-assembly 12 abuts the wire side wall 11, portion 13, and mesh sheet 43 of a second sub-assembly 12. Each member 40 is sealably coupled to the side wall 11 and portion 13 in a conventional manner (e.g., by a conventional welding process), such that fins 26 cooperate with members 14 and 40 to form material reception cells 49 which are disposed along a certain axis, such as axis 51. Further, portion 13 cooperates with member 40 to form pocket 24. Moreover, in the most preferred embodiment of the invention, each of the material containment cells 49 are of a substantially identical height and have a material support surface which is formed by the generally planar surface 16 (e.g., the material support surfaces of each of the cells 49 are co-planar). Particularly the axial alignment and co-planar nature of these cells 49 substantially reduces the amount of required storage space (e.g., allows the assembly 10 to be relatively flat and compact). Further, metal hydride material 48, in a powder form, is disposed within some or all of the cells 49 (e.g., upon the respective material support surface 16 and between a pair of adjacent conductive fins 26).

Further still, an aperture 50 is formed through the members 14, 40 and is effective to allow hydrogen gas to be communicated into and to be communicated from the contained metal hydride material 48 (i.e., aperture 50 operatively couples two adjacently coupled sub-assemblies 12 in a manner which permits hydrogen to be communicated to (or from) the pocket 24 of a first sub-assembly 12 out of (or into) the metal hydride 48 contained within the cells 49 of a second sub-assembly 12 through the pocket 24 of the second sub-assembly 12.

The top or "upper-most" storage sub-assembly 12 also includes a conductive lid member 44 which is coupled to the side wall 11 and portion 13 of the member 14 and which is substantially similar in size and shape to sheet 43. In one non-limiting embodiment, member 44 may also be coupled to the sheet 43 by the use of welded connections or by brazing. Further, sheet 43 may also be welded or brazed to the member 14 (e.g., to the side wall 11), thereby ensuring a secure or integral connection.

In one non-limiting embodiment of the invention, a single sub-assembly 12, which is coupled to a lid member 44, may selectively function as a complete storage assembly 10, however, should additional storage capacity be desired, one or more additional sub-assemblies 12 may be provided and, as shown best in FIG. 1, may be operatively and mutually coupled in a selectively stacked manner.

That is, mesh sheet 43 of a sub-assembly 12 is coupled to the member 40 of the sub-assembly 12 which directly resides above it. An aperture 50 is then extended through these stacked sub-assemblies 12 (e.g., an aperture is formed in each respective members 14, 40 and in each respective sheet 42, 43), thereby allowing hydrogen gas to be selectively communicated to these stacked sub-assemblies 12, through the extended aperture 50 and the communicating pockets 24, and allowing hydrogen gas to emanate from the sub-assemblies 12 or to be communicated into the stacked sub-assemblies 12. The aperture 50 is not extended through the member 44 which is located on the top or upper-most sub-assembly 12. Additionally, the aperture 50 is not extended through sheets 42, 43 of the top or upper sub-assembly 12 (i.e., the sheets 42, 43 which are adjacent to lid member 44). In one non-limiting embodiment, filter sheet 42 and mesh sheet 43 only overlay portion 16 of surface 15 (i.e., aperture 50 does not extend through sheets 42, 43). In another non-limiting embodiment, each pair of sheets 42, 43 overlay a unique one of formed aperture 50 (i.e., the aperture 50 is not formed in or extended through sheets 42, 43) and hydrogen is passed through these sheets 42, 43 when communicated between adjacent sub-assemblies 12.

Importantly, the compliant nature of the filter sheet 42 (and the wire sheet 43) allows the contained metal hydride material 48 to expand while reducing the likelihood of structural damage to the assembly 10 (e.g., the material 48 expands against the sheets 42, 43 due to its placement between adjacent fins 26 and causes the sheets 42, 43 to expand). That is, compliant filter sheet 42 substantially retains metal hydride material 48 within each cell 49 (i.e., prevents material 48 from "migrating" into undesirable locations), while permitting metal hydride material 48 to expand. Further, the compliant mesh sheet 43 allows hydrogen to freely travel along axis 51, above the filter sheet 42, and to be freely communicated to each cell 49, thereby allowing material 48 contained within assembly 10 to efficiently absorb and "deabsorb" or provide hydrogen gas. In one non-limiting embodiment, mesh sheet 43 may be eliminated. Moreover, the configuration of the corners 17, 18 and the extension of aperture 50 through pockets 24 cooperatively obviate the need for separate side members or conduits which permit hydrogen to be transmitted between stackably coupled sub-assemblies 12, thereby further reducing manufacturing costs.

In one non-limiting embodiment, hydrogen gas may be communicated to or from assembly 10 by a conventional port or connector (not shown) which is coupled to the aperture 50 formed in member 14 of the "bottom-most" sub-assembly 12 (i.e., the sub-assembly 12 whose member 14 is not coupled to a member 40 of another sub-assembly 12). In another non-limiting embodiment, member 14 of the bottom-most sub-assembly 12 does not have an aperture 50 or a connector and an aperture 50 is formed in the member 44 to permit a connector to be coupled to the top sub-assembly 12.

In operation, the fins 26, 32, and members 14, 40 of a sub-assembly 12, cooperate to efficiently transfer thermal energy to the various contained cells 49 within that sub-assembly 12. That is, heat or cold type energy is selectively applied to the assembly 10. The applied energy is then communicated and distributed throughout each sub-assembly 12 due to the previously described coupling arrangement of members 14, 40, 44, and fins 26, 32 (i.e., due to the physically coupled nature of the sub-assemblies 12 which cooperatively form assembly 10). Such distributed energy is therefore efficiency communicated to the contained metal hydride material 48 residing within each of the cells 49, effective to allow the material 48 to quickly and efficiently absorb or emit hydrogen.

Figure 3:
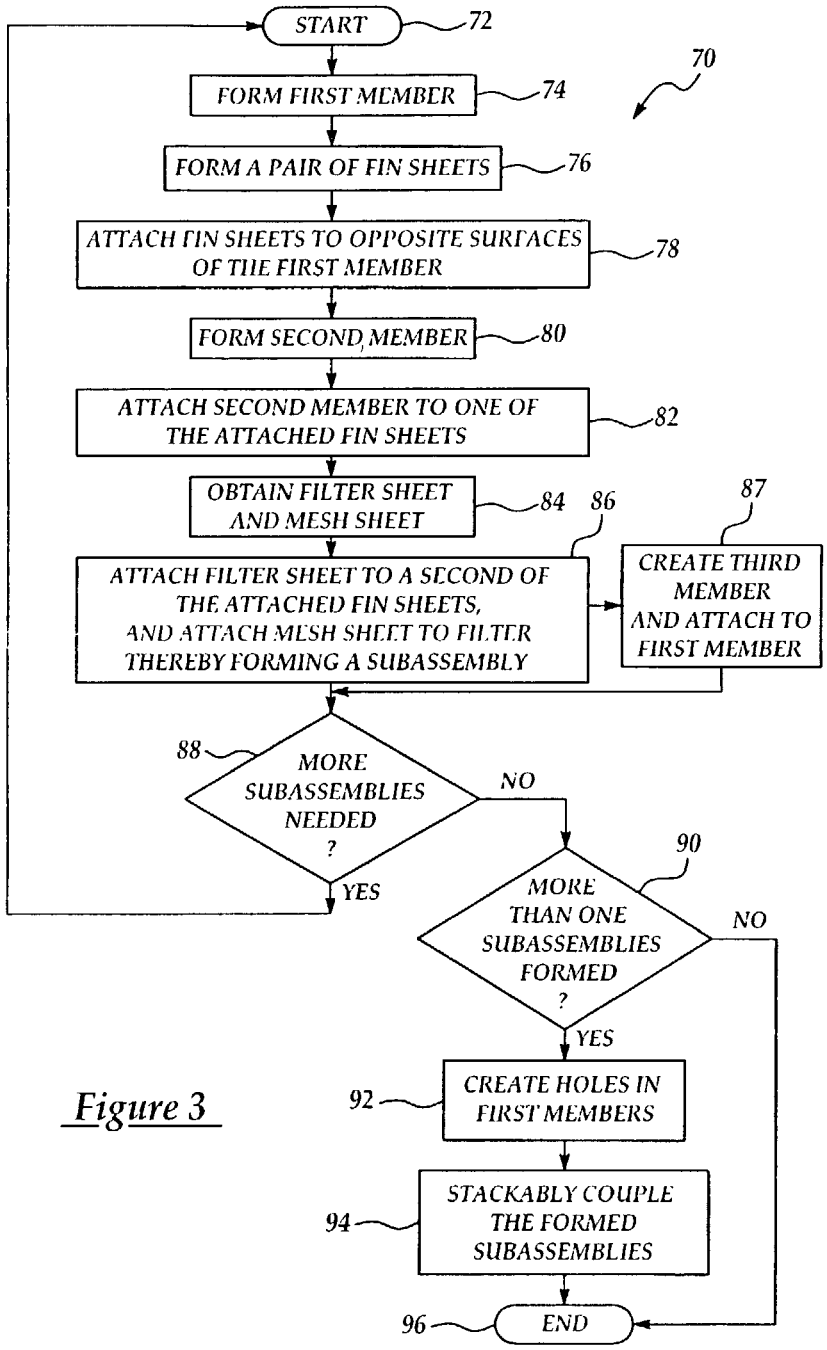
FIG. 3 is a flowchart illustrating a sequence of operational steps comprising the manufacturing methodology of the preferred embodiment of the invention.

As shown best in FIG. 3, the storage assembly 10 may be easily and cost effectively manufactured according to the methodology 70 which is shown in FIG. 3. Particularly, the methodology 70 includes a first step 72 in which the procedure is begun. Step 72 is followed by step 74 in which the first member 14 is formed by hydroforming or by a substantially similar cost effective process. Step 76 follows step 74 and, in this step 76, a pair of fin sheets 27, 33 are formed. Step 78 follows step 76 and, in this step 78, the fin sheets 27, 33 are respectively attached to the surfaces 16, 19. Step 80 follows step 78 and, in this step 80, the second member 40 is formed. In step 82, which follows step 80, the second member 40 is attached to the fins 32. Step 84 follows step 82 and, in this step 84, the compliant filter sheet 42 and the mesh sheet 43 are provided or obtained. Step 86 follows step 84 and, in this step 86, the filter sheet 42 overlays and may be coupled/attached to the fins 26 and the mesh sheet 43 overlays and may be coupled to the filter sheet 42.

Further, step 87 follows step 86 and, in this step 87, a third member 44 is created and is attached to the first member 14, thereby capturing the filter sheet 42 and mesh sheet 43 between the first and third members 14, 44. Step 88 follows step 87 and, in this step 88, it is determined whether additional sub-assemblies 12 are needed. If additional sub-assemblies 12 are needed, step 88 is followed by step 72. Alternatively, step 88 is followed by step 90 in which it is determined whether more than one sub-assemblies 12 have been formed in the process 70. If only a single sub-assembly 12 has been formed, step 90 is followed by step 96 in which the process 70 is ended. Alternatively, step 90 is followed by step 92 in which aperture 50 is created in each member 14 of each of the sub-assemblies 12 and step 94 follows step 92 in which the sub-assemblies 12 are stackably and operatively coupled as is shown in FIG. 1.

It should be understood that the foregoing invention is not limited to the exact construction or embodiment which has been delineated above, but that various changes and modifications may be made without departing from the scope of the inventions as are delineated in the following claims.

The invention claimed is:

1. An assembly comprising:

a plurality of material reception cells; and a compliant member which overlays said plurality of material reception cells, said compliant member comprising a wall surface of each of the material reception cells; and a plurality of conductive members which cooperatively form said plurality of material reception cells, wherein said plurality of conductive members comprises:

a plurality of fins which are disposed upon a substantially planar surface of a first member, said first member planar surface arranged substantially opposing said compliant member wall surface.

2. The assembly of claim 1 wherein said compliant member comprises a filter.

3. The assembly of claim 1 wherein each of said plurality of fins is substantially identical.

4. An assembly comprising:

a plurality of material reception cells;

a compliant member which overlays said plurality of material reception cells;

a plurality of conductive members which cooperatively form said plurality of material reception cells;

wherein said plurality of conductive members comprises a first member;

a plurality of fins which are disposed upon a surface of said first member;

wherein said plurality of conductive members further comprise a second plurality of fins which are disposed upon a second surface of said first member;

a second member which is coupled to said first plurality of fins; and a third member which is coupled to said second plurality of fins.

5. The assembly of claim 1 wherein each of said plurality of material reception cells is substantially identical and wherein each of said plurality of material reception cells includes a flat material reception surface.

6. The assembly of claim 1 wherein said assembly further comprises a compliant mesh sheet which overlays and is coupled to said compliant member.

7. An assembly comprising a first and a second substantially identical storage assembly, each of said first and second storage assemblies respectively having a plurality of metal hydride storage cells;

a plurality of heat transfer members which are communicatively coupled to each of said plurality of metal hydride storage cells;

said heat transfer members comprising:

a plurality of fins which are disposed upon a substantially planar surface of a first member, said first member planar surface arranged substantially opposing a compliant filter member surface; and wherein said compliant filter member surface overlays each of said metal hydride storage cells, and wherein said respective plurality of heat transfer members of said first storage assembly are physically and communicatively coupled to said plurality of metal hydride storage cells of said second storage assembly, thereby allowing energy to be efficiently transferred to each of said plurality of metal hydride storage cells of each of said first and second storage assemblies and allowing hydrogen gas to emanate from said assembly and to be selectively received by said assembly.

8. The assembly of claim 7 wherein each of said plurality of metal hydride storage cells of said first storage assembly is substantially identical to each of said plurality of metal hydride storage cells of said second storage assembly.

9. The assembly of claim 8 wherein each of said plurality of metal hydride storage cells has a substantially rectangular cross sectional area.

10. The assembly of claim 7 wherein each of said plurality of heat transfer members of said first storage assembly is substantially identical to each of said heat transfer members of said second storage assembly.

11. The assembly of claim 10 wherein each of said heat transfer members is formed from copper.

12. The assembly of claim 7 wherein each of said first and second storage assemblies further comprises a compliant mesh sheet which overlays and is coupled to said compliant filter member.

13. A method for forming a metal hydride storage assembly comprising the steps of:

creating a first member having a first and a second surface;

providing a first and a second plurality of fins;

attaching said first plurality of fins to said first surface, effective to create a plurality of material reception cells;

attaching said second plurality of fins to said second surface;

providing a third member;

attaching said third member to said second plurality of fins;

providing a compliant filter sheet;

attaching said compliant filter sheet to said first plurality of fins, thereby forming a first metal hydride storage sub-assembly;

creating a second metal hydride storage sub-assembly which is substantially identical to said first metal hydride storage sub-assembly; and coupling said second metal hydride storage sub-assembly to said second plurality of fins of said first metal hydride storage sub-assembly, thereby forming said metal hydride storage assembly.

14. The method of claim 13 wherein said plurality of material reception cells are each substantially identical.

15. The method of claim 13 further comprising the step of causing said first surface to be flat.

16. The method of claim 15 further comprising the step of placing an amount of metal hydride material upon said first flat surface.

17. The method of claim 13 wherein said step of attaching said first plurality of fins to said first surface further comprises the steps of:

providing a sheet;

coupling said first plurality of fins to said sheet, wherein said first plurality of fins are orthogonal to said sheet; and coupling said sheet to said first surface.

18. The method of claim 13 further comprising the step of forming said first plurality of fins from copper.

* * * * *